US006660235B1

(12) United States Patent
Holpp et al.

(10) Patent No.: US 6,660,235 B1
(45) Date of Patent: Dec. 9, 2003

(54) CATALYST CARRIER CONFIGURATION FOR INSTALLATION CLOSE TO AN ENGINE

(75) Inventors: Helmut Holpp, Siegburg (DE); Friedrich-Wilhelm Kaiser, Neunkirchen-Seelscheid (DE); Uwe Siepmann, Köln (DE); Ludwig Wieres, Overath (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/518,469

(22) Filed: Mar. 3, 2000

Related U.S. Application Data

(63) Continuation of application No. PCT/EP98/05364, filed on Aug. 24, 1998.

(30) Foreign Application Priority Data

Sep. 3, 1997 (DE) ..... 197 38 585
Sep. 9, 1997 (DE) ..... 197 39 476
Dec. 15, 1997 (DE) ..... 197 55 703

(51) Int. Cl.[7] ..... F01N 3/28; F01N 7/18
(52) U.S. Cl. ..... 422/180; 422/177
(58) Field of Search ..... 422/179, 180, 422/181, 171, 177, 174

(56) References Cited

U.S. PATENT DOCUMENTS 4,374,803 A * 2/1983 Fratzer et al. ..... 422/176
4,504,294 A * 3/1985 Brighton ..... 422/179
5,413,767 A * 5/1995 Breuer et al. ..... 422/174

FOREIGN PATENT DOCUMENTS

| | | | |
|---|---|---|---|
| DE | 26 35 725 | A1 | 3/1977 |
| DE | 40 38 169 | A1 | 6/1992 |
| DE | 43 17 092 | A1 | 11/1994 |
| DE | 43 22 526 | A1 | 1/1995 |
| GB | 2 231 283 | A | 11/1990 |

OTHER PUBLICATIONS

Japanese Patent Abstract No. 03260314 (Fumio), dated Nov. 20, 1991.

International Patent Application WO 90/02251 (Swars), dated Mar. 8, 1990.

International Patent Application WO 90/13736 (Wieres), dated Nov. 15, 1990.

* cited by examiner

*Primary Examiner*—Hien Tran
(74) *Attorney, Agent, or Firm*—Laurence A. Greenberg; Werner H. Stemer; Ralph E. Locher

(57) ABSTRACT

A catalyst carrier configuration includes a housing and at least one catalyst carrier body disposed in the housing. The catalyst carrier body has partition walls defining a plurality of passages for an exhaust gas. A flange surrounds the catalyst carrier body and extends radially outwards from the catalyst carrier body. The flange has a section that extends at least partially into an outer wall of the housing and can be disposed between a cylinder head and a manifold of an internal combustion engine. The catalyst carrier configuration can be mounted close an internal combustion engine. A structural unit having at least two catalyst carrier configurations and an exhaust system are also provided.

40 Claims, 8 Drawing Sheets

CATALYST CARRIER CONFIGURATION FOR INSTALLATION CLOSE TO AN ENGINE

Cross-Reference to Related Application:

This application is a continuation of copending International Application No. PCT/EP98/05364, filed Aug. 24, 1998, which designated the United States.

BACKGROUND OF THE INVENTION

Field of the Invention

The invention relates to a catalyst carrier configuration, a structural unit having catalyst carrier configurations and further relates to an exhaust system of an internal combustion engine.

For catalytically converting components of an exhaust gas from an internal combustion engine, it is known to apply at least one catalytically active substance to a catalyst carrier. The catalyst carrier has gas passages through which an exhaust gas can flow. The gas passages extend in the longitudinal direction of the catalyst carrier. It is known to provide a catalyst carrier in the form of a honeycomb. The catalyst carrier may be formed from layers of sheet metal which are at least partially structured. Furthermore, catalyst carriers which are formed of a ceramic material are known. Such catalyst carriers are extruded.

The catalyst carrier is disposed in a housing which is part of an exhaust system. Various configurations of the housing are known depending on the material of the catalyst carrier.

International Patent Publication WO 90/02251 describes a housing with a catalyst carrier which is suitable in particular for installation close to the engine and within the exhaust system. The housing has a larger cross section than the catalyst carrier. The housing has an approximately rectangular opening, the length of which is greater than the maximum length of the catalyst carrier and the width of which is greater than the maximum width of the catalyst carrier. The catalyst carrier is attached to a flat or curved retention plate which has a greater length and width than the opening in the housing. The retention plate serves as a closure cover for the housing, the catalyst carrier projecting into an inner chamber in the housing. This simplifies installation of the catalyst carrier in the housing and removal of the catalyst carrier from the housing.

Further configurations of catalyst carrier configurations are known, for example, from International Patent Publications WO 96/27735, WO 96/01698 and WO 96/19647.

Particularly in the case of internal combustion engines which are installed in passenger vehicles, installing a catalyst carrier close to the engine is not without problems, since the spatial conditions inside an engine chamber of the vehicle are relatively constricted.

Published German Patent Application DE 26 35 725 A1 discloses a catalyst carrier configuration having a housing in which at least one catalyst carrier is disposed. The catalyst carrier has a plurality of passages which are separated from one another by partitions and extend in an axial direction of the catalyst carrier. The housing has a flange which is directed essentially radially outwards. The flange can be provided between a cylinder head and a manifold of an internal combustion engine. The housing is formed integrally with the flange.

Published German Patent Application DE 43 17 092 A1 discloses a catalyst carrier configuration which is disposed in the exhaust manifold of an internal combustion engine. The catalyst carrier configuration has a housing which is configured in the form of a frame. The framelike housing has collar-like beads, in order to ensure that a catalyst carrier is fixed both radially and axially in the housing. The housing is connected to a flange. The flange is welded to one of the collar-like beads. It is also known from Published German Patent Application DE 43 17 092 A1 that it is possible to connect the flange to a plurality of housings.

Published German Patent Application DE 43 22 526 A1 discloses a further configuration of a catalyst carrier configuration for an internal combustion engine. The catalyst carrier configuration has a housing in which a catalyst carrier is provided. A flange which has a collar which is fixed to the housing is connected to the housing. The flange is fixed, together with an exhaust pipe, to the cylinder head of an internal combustion engine.

SUMMARY OF THE INVENTION

It is accordingly an object of the invention to provide a catalyst carrier configuration which overcomes the above-mentioned disadvantages of the heretofore-known configurations of this general type and which is of simple construction and allows installation close to an engine.

A further object of the invention is to provide a structural unit which simplifies the assembly of at least two catalyst carrier bodies in the vicinity of the internal combustion engine.

A still further object of the invention is to provide an exhaust system of an internal combustion engine which can be produced with little outlay.

With the foregoing and other objects in view there is provided, in accordance with the invention, a catalyst carrier configuration, including:

a housing having an outer wall;

at least one catalyst carrier body disposed in the housing, the at least one catalyst carrier body defining an axial direction and having partition walls defining a plurality of passages separated from one another by the partition walls and extending essentially in the axial direction; and at least one flange surrounding at least the at least one catalyst carrier body and extending essentially radially outwards from the at least one catalyst carrier body, the at least one flange having at least one section extending at least partially into the outer wall and being configured to be disposed between a cylinder head and a manifold of an internal combustion engine.

In other words, the construction of the catalyst configuration according to the invention has a housing in which a catalyst carrier body is disposed which has a plurality of passages which are separated from one another by partition walls and extend in an axial direction of the catalyst carrier body. The housing extends at least partially in an axial direction of the catalyst carrier body. The configuration according to the invention has a housing which has at least one flange which is directed essentially radially outwards, at least partially surrounds the catalyst carrier body and can be disposed between a cylinder head and a manifold of an internal combustion engine. The flange has at least a section which projects at least partially into the housing. This construction of the catalyst configuration according to the invention forms a sharp transition between the housing and the flange, so that the catalyst carrier configuration according to the invention requires relatively little installation space. Particularly in the case of existing internal combustion engines, the problem exists that they cannot be retrofitted with catalyst carrier configurations of this type since a catalyst carrier configuration as is known, for example, from Published German Patent Application DE 43 22 526 A1 has a radius of curvature in the transition region between the exhaust manifold or the cylinder head and the housing. Such a catalyst carrier configuration can only be fitted by adapting the further components. With the catalyst carrier configuration according to the invention it is not absolutely necessary to adapt the exhaust manifold or the cylinder head in this way.

Due to the fact that the flange extends at least partially into the housing, the load on a joint between flange and housing is also relieved, since some of the forces acting on the catalyst carrier body and the housing are introduced directly into the flange via the housing. Relieving the load on the joint between the housing and the flange also has a beneficial effect on the service life and durability of the catalyst carrier configuration.

The construction of the catalyst carrier configuration according to the invention also allows retrofitting on existing internal combustion engines, with the result that emissions of certain harmful components of the exhaust gas can be reduced.

The catalyst carrier configuration preferably has dimensions which are such that the catalyst carrier body can be introduced at least partially into an outlet passage from an internal combustion engine. This configuration means that the catalyst carrier body, which is provided with a catalyst, can quickly be brought to its operating temperature, so that the emission of harmful components is reduced during a cold-start phase of an internal combustion engine, in particular a vehicle engine.

In accordance with an advantageous feature of the invention, the housing has on or in its outer wall a recess into which at least one section of the flange projects. The recess is preferably formed by a groove, in particular a continuous, encircling groove. The flange has a passage opening which preferably has an internal diameter which is greater than the external diameter of the housing. The flange is positioned in the region of the groove. Due to a radially outwardly directed deformation of the housing, at least in the region of the groove, the section of the flange passes into the recess. The plastic deformation of the housing can be achieved by placing the housing under a sufficiently high internal pressure. If appropriate, the deformation of the housing may take place at an elevated temperature.

In accordance with another feature of the invention, the recess is formed by at least one radially outwardly directed stamped or swaged section in the outer wall. The swaged or stamped section is preferably structured in the form of a bead.

In accordance with another feature of the invention, a section of the flange extends as far as the catalyst carrier body. If the catalyst carrier configuration is configured in this way, the housing is preferably of two-part construction.

In accordance with yet another feature of the invention, the housing has an extent in the axial direction of the catalyst carrier body which is smaller, preferably significantly smaller, than a length of the catalyst carrier body. As a result, the catalyst carrier configuration has a relatively low heat-storage mass, so that an operating temperature of the catalyst carrier configuration can be reached more quickly. A further advantage of this configuration is that the external dimensions of the catalyst carrier configuration can be reduced to a required level so that when the catalyst carrier configuration is disposed in an outlet from an internal combustion engine there is no need to enlarge an outlet passage. It is also achieved that the free flow cross section in the outlet passage is reduced by the catalyst carrier configuration only by an insignificant amount. Furthermore, the flow behavior of the exhaust gas is affected only insignificantly.

A housing whose extent in the axial direction of the catalyst carrier body is smaller, preferably significantly smaller, than a length of the catalyst carrier body is suitable in particular for accommodating metallic catalyst carrier bodies which are wound helically or spirally.

If it is intended, instead of a helically or spirally wound catalyst carrier body, to provide, for example, a catalyst carrier body which is wound in the form of an S in the housing, it is advantageous for the housing to be formed by at least two housing parts, each housing part extending over part of the longitudinal extent of the catalyst carrier body. This configuration of the housing has the advantage that it prevents the catalyst carrier body being spread open by the housing parts. It is not necessary for the overall length of the individual housing parts to correspond to the overall length of the catalyst carrier body. There may be free sections between individual housing parts. Given a sufficiently long housing, it is also possible for a catalyst carrier body which is wound in the form of an S to be disposed in a single-piece housing.

In accordance with yet another feature of the invention, the housing or the housing parts are provided in the form of a ring or sleeve. This configuration has the advantage that the housing or the housing parts are relatively simple to produce. The external contour of the housing or the housing parts preferably corresponds to the cross section of the outlet passage or of the exhaust-gas flow path adjoining the outlet passage.

According to a further advantageous embodiment of the invention, the flange forms a single carrying unit together with a housing or with a housing part. This has the advantage that there is no need to handle a plurality of parts.

According to a further advantageous embodiment of the carrying unit, the housing or a housing part have at least one stop which can be brought to bear against a catalyst carrier body. This allows a defined installation position of a catalyst carrier body inside the housing or the housing part.

Preferably, the catalyst carrier configuration is configured in such a way that the flange has at least one sealing surface for gastight connection to a manifold and a cylinder head. The sealing surface is preferably of annular construction, so that it surrounds the catalyst carrier body. In this case, a preferred embodiment of the catalyst configuration is one in which the flange itself forms a seal. Such a catalyst carrier configuration is suitable particularly when the catalyst carrier configuration is disposed directly on the internal combustion engine, since it is possible to dispense with additional sealing devices. Thus the flange forms a seal between an engine block and a manifold of the internal combustion engine. The proximity of the catalyst carrier configuration to the combustion chamber of an internal combustion engine ensures that the catalyst carrier body heats up relatively quickly, with the result that the catalyst carrier configuration can be fully effective within a short time. The flange preferably forms a metallic seal.

Depending on the geometry of the seal, it may, under certain circumstances, be expedient to provide the flange with at least one sealing element, with the result that the costs of producing the flange can be reduced, since there is no need to accurately form sealing surfaces on the flange.

According to a further advantageous embodiment of the catalyst carrier configuration, the catalyst carrier body is a metallic catalyst carrier body, preferably a monolithic honeycomb body. Using a metallic catalyst carrier body has the advantage that the catalyst carrier body can be soldered at least to the housing and/or the flange, so that an increased stability of the catalyst carrier configuration is achieved.

The metallic catalyst carrier body may include layers of metal sheet which are at least partially structured. As an alternative, the catalyst carrier body may be produced from a sintered metal.

As an alternative to a metallic catalyst carrier body, it is also possible to use a ceramic catalyst carrier body. In this case, however, it should be ensured that the different thermal expansions caused by different coefficients of expansions of the materials of the catalyst carrier body and of the housing, which is metallic, are compensated for by suitable measures.

According to a further advantageous embodiment of the catalyst carrier configuration, the catalyst carrier body has at least one region which has at least one passage which has a larger cross section than the further passages. This measure ensures that the flow behavior of the exhaust-gas stream is not affected, or is affected only to a very slight extent, by the catalyst carrier body. Such an effect is important in particular if it has a feedback effect on the mixture formation within a combustion chamber of an internal combustion engine.

With the objects of the invention in view there is also provided, a structural unit, including:

at least two catalyst carrier configurations, each including a housing having an outer wall and a catalyst carrier body disposed in the housing, the catalyst carrier body defining an axial direction and having partition walls defining a plurality of passages separated from one another by the partition walls and extending essentially in the axial direction; and a common flange surrounding the catalyst carrier body of each of the at least two catalyst carrier configurations and extending essentially radially outwards, the common flange having at least one section extending at least partially into the outer wall of each of the at least two catalyst carrier configurations and being configured to be disposed between a cylinder head and a manifold of an internal combustion engine.

The number of catalyst carrier configurations preferably corresponds to the number of outlet passages from an internal combustion engine. As a result, it is possible to reduce the assembly outlay on the catalyst carrier configurations. In particular in the case of a structural unit in which the number of catalyst carrier configurations corresponds to the number of outlet passages of an internal combustion engine, it is possible, given a suitable configuration of the internal combustion engine and an appropriately configured structural unit, to connect this structural unit directly to the internal combustion engine, so that part of each catalyst carrier body projects into an outlet passage of the internal combustion engine.

Preferably, such a structural unit is configured in such a way that each catalyst support is disposed inside a sealing surface. As an alternative, appropriate seals may be formed on the joint or common collar for each catalyst support.

With the objects of the invention in view there is also provided, an exhaust system for an internal combustion engine, including:

an exhaust system component defining at least one exhaust flow path; and a catalyst carrier configuration including a housing having an outer wall, at least one catalyst carrier body disposed in the housing and provided at least partly in the at least one exhaust flow path, the at least one catalyst carrier body defining an axial direction and having partition walls defining a plurality of passages separated from one another by the partition walls and extending essentially in the axial direction, and a at least one flange surrounding at least the at least one catalyst carrier body and extending essentially radially outwards from the at least one catalyst carrier body, the at least one flange having at least one section extending at least partially into the outer wall and being configured to be disposed between a cylinder head and a manifold of an internal combustion engine.

With the objects of the invention in view there is further provided, an exhaust system for an internal combustion engine, including:

an exhaust system component defining exhaust flow paths; and a structural unit including at least two catalyst carrier configurations, each including a housing having an outer wall and a catalyst carrier body disposed in the housing and provided at least partly in a respective one of the exhaust flow paths, the catalyst carrier body defining an axial direction and having partition walls defining a plurality of passages separated from one another by the partition walls and extending essentially in the axial direction, and a common flange surrounding the catalyst carrier body of each of the at least two catalyst carrier configurations and extending essentially radially outwards, the common flange having at least one section extending at least partially into the outer wall of each of the at least two catalyst carrier configurations and being configured to be disposed between a cylinder head and a manifold of an internal combustion engine.

The exhaust systems according to the invention make it possible to install catalyst carrier bodies in the immediate vicinity of an internal combustion engine.

Preferably, one catalyst carrier body is in each case disposed in each flow path, making it possible to reduce the emission of harmful components in the exhaust gas. In order to make the exhaust system as effective as possible and to avoid bypass flows of an exhaust gas, each catalyst carrier body with a housing has a cross section which essentially corresponds to a cross section of an exhaust-gas flow path.

According to a further advantageous embodiment of the exhaust system having at least one manifold which has at least one flange for connection to an internal combustion engine, the collar bears at least partially against the flange. In particular, the collar is configured in such a way that it can be connected to the flange in a gastight manner. Other features which are considered as characteristic for the invention are set forth in the appended claims.

Although the invention is illustrated and described herein as embodied in a catalyst carrier configuration for installation close to the engine, a structural unit having catalyst carrier configurations and an exhaust system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
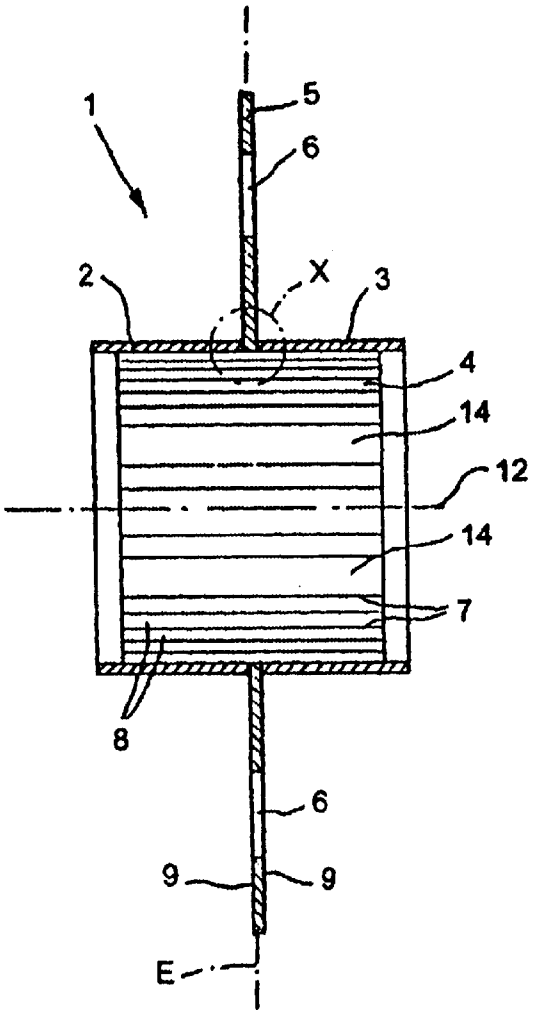
FIG. 2 is a sectional side view of the catalyst carrier configuration according to FIG. 1.
Figure 1:
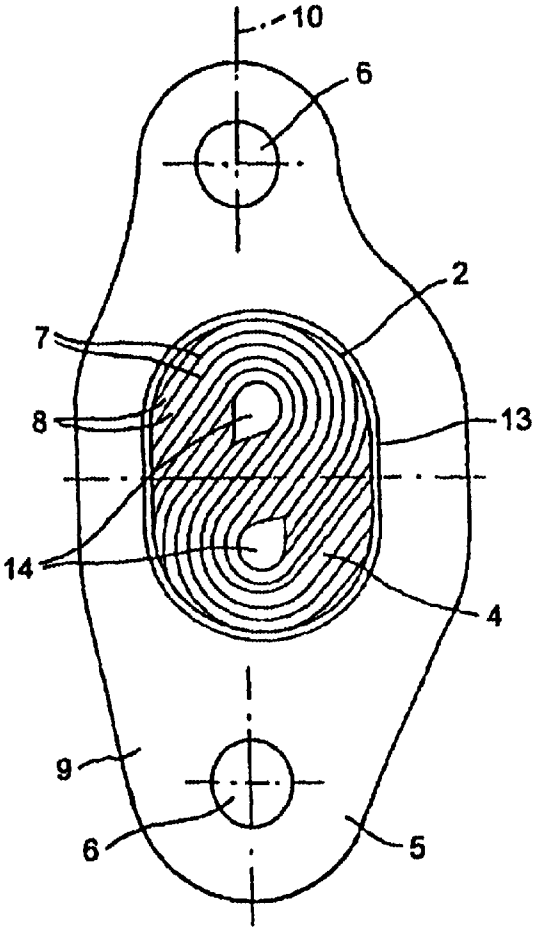
FIG. 1 is a front view of a first exemplary embodiment of a catalyst carrier configuration according to the invention.

Referring now to the figures of the drawings in detail and first, particularly, to FIGS. 1 and 2 thereof, there is shown a first exemplary embodiment of a catalyst carrier configuration. The catalyst carrier configuration has a housing 1 which is of two-part construction. The housing 1 has a first housing part 2 and a second housing part 3. The first housing part 2 and the second housing part 3 are of essentially tubular construction. A catalyst carrier or more specifically a catalyst carrier body 4 is provided inside the housing 1. The catalyst carrier 4 has a plurality of passages 8 which are separated from one another by partitions or partition walls 7 and extend in the longitudinal direction of the longitudinal axis 12 of the catalyst carrier 4. In the exemplary embodiment illustrated, the catalyst carrier 4 is formed by layers of sheet metal which are at least partially structured and are preferably intertwined in the form of an S. Other configurations of the catalyst carrier 4 are possible. The catalyst carrier may also be formed of a nonmetallic material, in particular of a ceramic.

The housing 1 is divided in a division plane E which runs essentially transversely to the longitudinal direction of the passages 8. In the exemplary embodiment illustrated, the division plane E lies essentially in a plane of symmetry of the catalyst carrier 4. However, this is not absolutely necessary. The housing may also be divided asymmetrically.

A flange 5 is provided between the first housing part 2 and the second housing part 3. The flange 5 is disposed in the division plane E. The catalyst carrier 4 penetrates through the flange 5. For this purpose, the flange 5 has a passage opening 13 which is adapted to the outer contour of the catalyst carrier 4. The flange 5 extends through the housing 1 as far as the catalyst carrier 4.

The metallic catalyst carrier 4 is at least partially connected to the first housing part 2 and the second housing part 3 of the housing 1. The joint between the catalyst carrier 4 and the first housing part 2 or the second housing part 3 is preferably a soldered joint. Preferably, there is also a soldered joint between the flange 5 and the catalyst carrier 4. In addition, or as an alternative, there may be a soldered joint between the flange 5 and the first housing part 2 and/or the second housing part 3 of the housing 1. The joint between the flange 5 and the first housing part 2 and/or the second housing part 3 of the housing 1 may also be a material-to-material joint. The joint may be formed, by way of example, by welding, in particular by laser welding, friction welding, arc welding or resistance welding.

Figure 3:
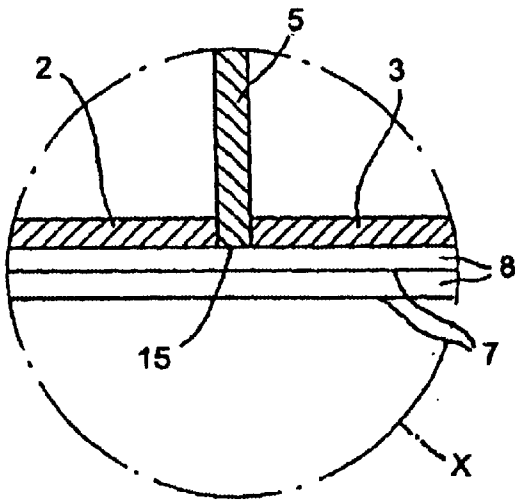
FIG. 3 is an enlarged sectional view of a detail X according to FIG. 2.

The flange 5 is essentially perpendicular to the longitudinal axis 12 of the catalyst carrier 4. It is also configured to be essentially perpendicular to the housing 1. Due to the fact that the flange 5 extends as far as the catalyst carrier 4, there is a sharp-edged transition between the flange 5 and the housing 1. This sharp-edged transition between the flange 5 and the housing 1 allows the catalyst carrier configuration to be positioned very accurately in the exhaust duct of an exhaust system. In particular, it is not absolutely necessary to machine the edge of an outlet passage on the cylinder. Due to the fact that the flange 5 projects into the housing 1, the forces acting on the housing 1 from the catalyst carrier 4 are also introduced into the flange 5 via the housing 3. In the exemplary embodiment illustrated, the end faces of the housing parts 2, 3 butt against the flange 5. Via these end faces, a force which is acting on the catalyst carrier and is caused by the flowing exhaust gas is introduced into the flange 5. This reduces the load on the connection between the flange 5 and the catalyst carrier 4 or between the flange 5 and the first housing part 2 and/or the second housing part 3 of the housing 1. FIG. 3 shows an enlarged illustration of the connection region between the housing parts 2, 3 and the flange 5.

The flange 5 has two bores 6, through which attachment elements, in particular screws, can project, through the use of which elements the catalyst carrier configuration is connected to an exhaust system. The bores 6 lie on a common axis 10. The flange 5 is configured as a seal which has at least one sealing surface 9.

As can be seen in particular from FIG. 1, the catalyst carrier 4 has two passages or channels 14 which are formed at a distance from one another and have a larger cross section than the other passages or channels 8 of the catalyst carrier 4. The passages 14 are formed essentially in the central region of the catalyst carrier 4. In the case of the catalyst carrier 4 illustrated in FIG. 1, the passages 14 are formed in the regions in which winding spindles engage for producing the catalyst carrier 4. The catalyst carrier is preferably produced in accordance with a method which is described in International Patent Publication WO 97/00725 or WO 97/00135.

Figure 6:
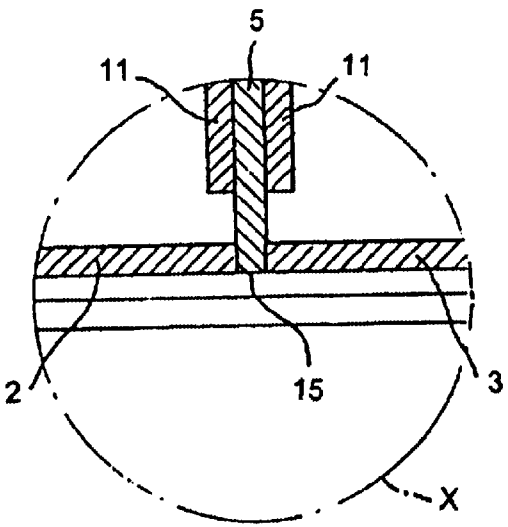
FIG. 6 is an enlarged sectional view of a detail X according to FIG. 5.
Figure 5:
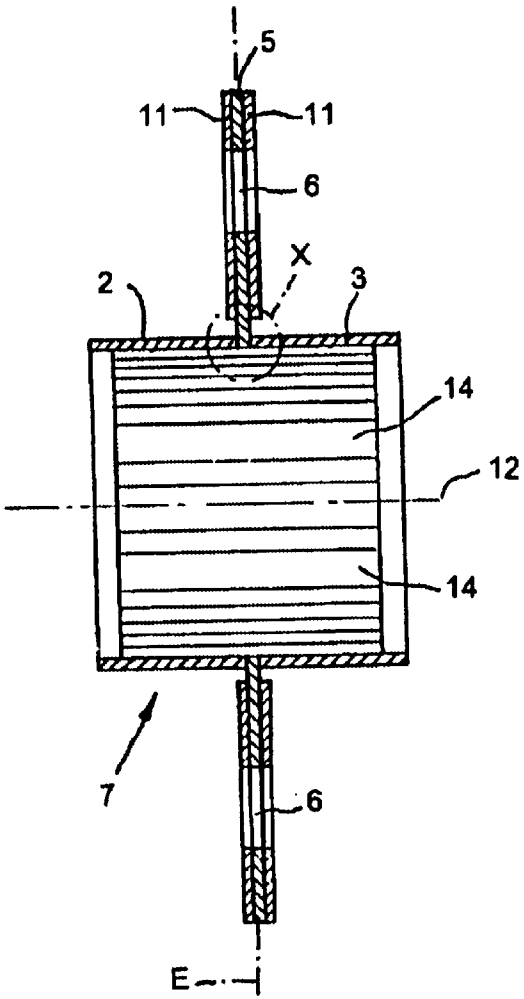
FIG. 5 is a sectional view of the catalyst carrier configuration according to FIG. 4.
Figure 4:
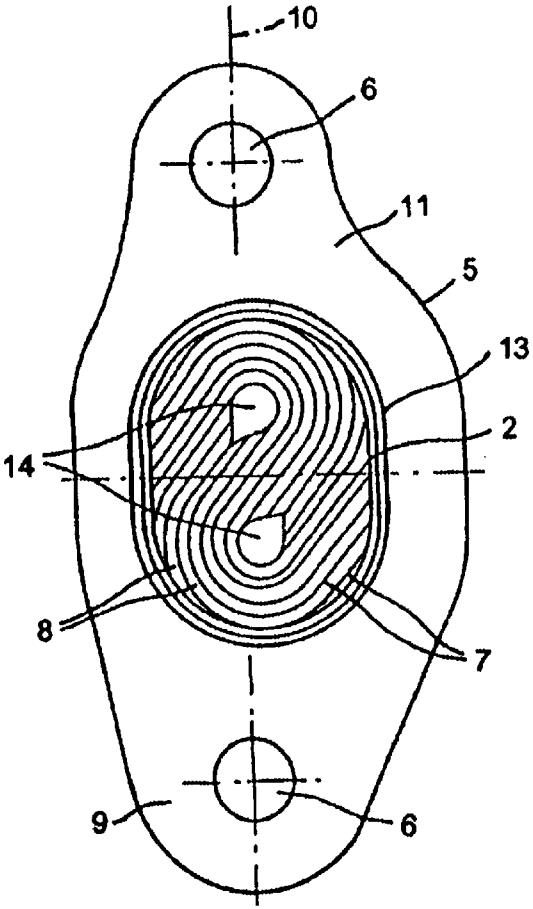
FIG. 4 is a front view of a second exemplary embodiment of a catalyst carrier configuration according to the invention.

FIGS. 4, 5 and 6 show a second exemplary embodiment of a catalyst carrier configuration. The catalyst carrier configuration has a two-part housing 1. A catalyst carrier 4 is disposed in the housing 1. The catalyst carrier 4 has a plurality of passages 8 which are separated from one another by partitions or partition walls 7. The passages 8 extend in the longitudinal direction of the catalyst carrier. The partitions 7 may be formed by metal sheets which are at least partially structured.

The housing 1 is divided in a division plane E which runs essentially transversely to the longitudinal direction of the passages 8, so that the housing 1 has a first housing part 2 and a second housing part 3. Each housing part 2, 3 partially surrounds the catalyst carrier 4.

A flange 5 is disposed between the first housing part 2 and the second housing part 3 of the housing 1. The flange 5 is of platelike construction. It is disposed in the division plane E. The flange 5 has a passage opening 13 through which the catalyst carrier 4 extends. The form of the passage opening 13 essentially corresponds to the outer contour of the catalyst carrier 4. The inner edge 15 of the passage opening 13 bears against the outer casing of the catalyst carrier 4. The flange 5 is preferably soldered to the catalyst carrier 4.

The flange 5 has sealing elements 11, which are disposed on opposite surfaces, with sealing faces 9. The sealing elements 11 end at a distance from the first housing part 2 and the second housing part 3, as can be seen in particular from FIG. 6.

The flange 5 is disposed between the housing parts 2, 3, as illustrated by FIG. 6. The mutually facing end faces of the housing parts 2, 3 bear against the flange 5. The flange 5 extends as far as the catalyst carrier 4. The flange 5 can be joined to the housing 1 or to the housing parts 2, 3 in the manner which has already been explained with reference to the first exemplary embodiment.

Figure 8:
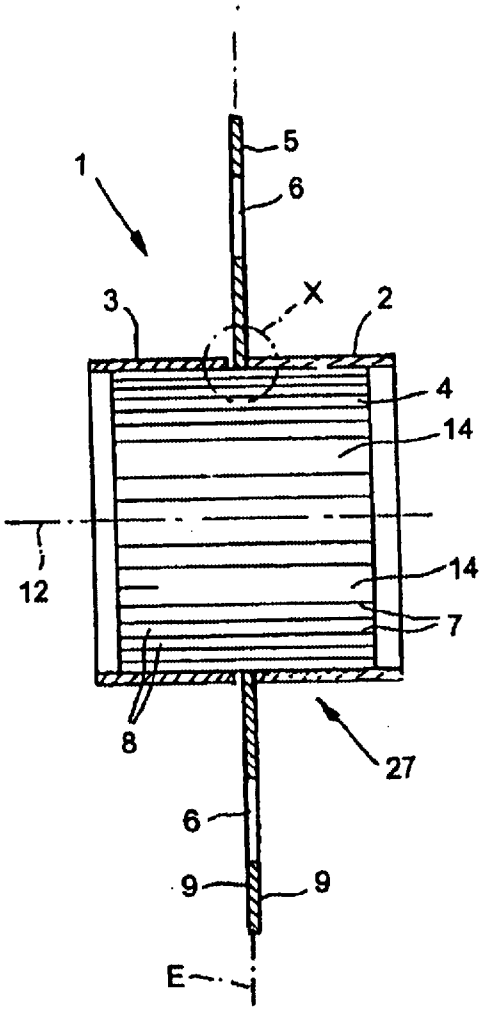
FIG. 8 is a sectional side view of the catalyst carrier configuration according to FIG. 7.
Figure 7:
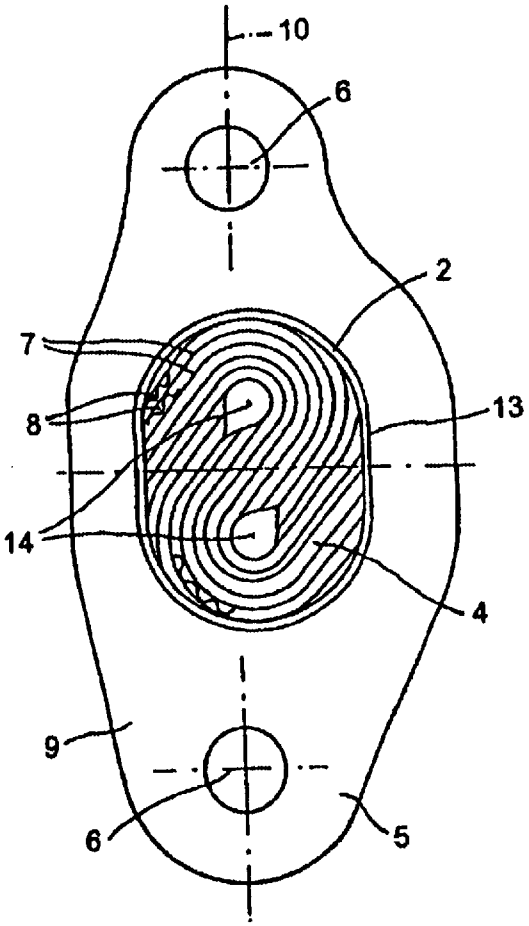
FIG. 7 is a front view of a third exemplary embodiment of a catalyst carrier configuration according to the invention.

FIGS. 7, 8 show a further exemplary embodiment of a catalyst carrier configuration. The catalyst carrier configuration has a housing 1 which is of two-part construction. The housing 1 has a first housing part 2 and a second housing part 3. The first housing part 2 and the second housing part 3 are of essentially tubular construction. A catalyst carrier 4 is disposed inside the housing 1. The catalyst carrier 4 has a plurality of passages 8 which are separated from one another by partitions 7 and extend in the longitudinal direction of the longitudinal axis 12 of the catalyst carrier 4.

In the exemplary embodiment illustrated, the catalyst carrier 4 is formed by layers of metal sheet which are at least partially structured and are intertwined essentially in the form of an S, as can be seen from FIG. 7. Other configurations of the catalyst carrier 4 are possible. The housing 1 is divided in a division plane E which runs essentially transversely to the longitudinal direction of the passages 8. In the exemplary embodiment illustrated, the division plane E lies essentially in a plane of symmetry of the catalyst carrier 4. However, this is not absolutely necessary.

A flange 5 is formed between the first housing part 2 and the second housing part 3. The flange 5 lies in the division plane E. The catalyst carrier 4 penetrates through the flange 5. To this end, the flange 5 has a passage opening 13 which is adapted to the outer contour of the catalyst carrier 4.

The flange 5 and the housing part 2 form a carrying unit 27. The housing part 2 and the flange 5 are connected to the housing part 2. The flange 5 is preferably soldered or welded to the housing part 2.

Figure 9:
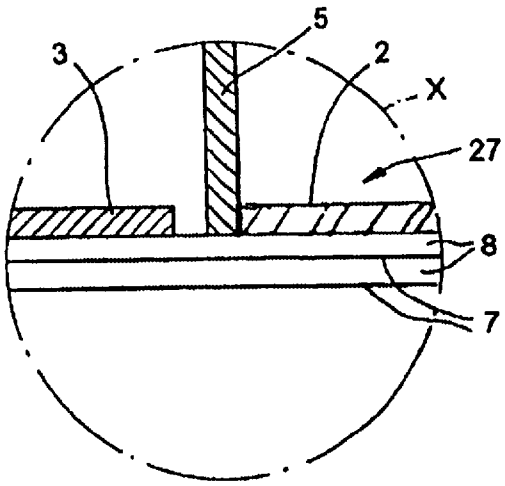
FIG. 9 is an enlarged sectional view of a detail X according to FIG. 8.

As can be seen in particular from FIG. 9, the second housing part 3 lies at a certain distance in the axial direction from the flange 5.

The metal catalyst carrier 4 is preferably at least partially connected to the first housing part 2 and the second housing part 3 of the housing 1. The joint between the catalyst carrier 4 and the first housing part 2 or the second housing part 3 is preferably a soldered joint. There is preferably also a soldered joint between the flange 5 and the catalyst carrier 4.

The flange 5 has two bores 6 through which attachment elements, in particular screws, can extend, through the use of which elements the catalyst carrier configuration can be connected to a cylinder head and/or a manifold of an internal combustion engine. The bores lie on a common axis 10.

The flange 5 is of platelike construction. It preferably forms a seal which has at least one sealing surface 9.

As can be seen in particular from FIG. 7, the catalyst carrier 4 has two main passages 14 which are formed at a distance from one another and have a larger cross section than the other passages 8 in the catalyst carrier 4. The passages 14 are formed essentially in the central region of the catalyst carrier 4. In the case of the catalyst carrier 4 illustrated in FIG. 7, the main passages 14 are formed in the regions in which winding spindles engage for the purpose of producing the catalyst carrier 4. The catalyst carrier is preferably produced in accordance with the method which is known from International Patent Publication WO 97/00725 or WO 97/00135.

Figure 10:
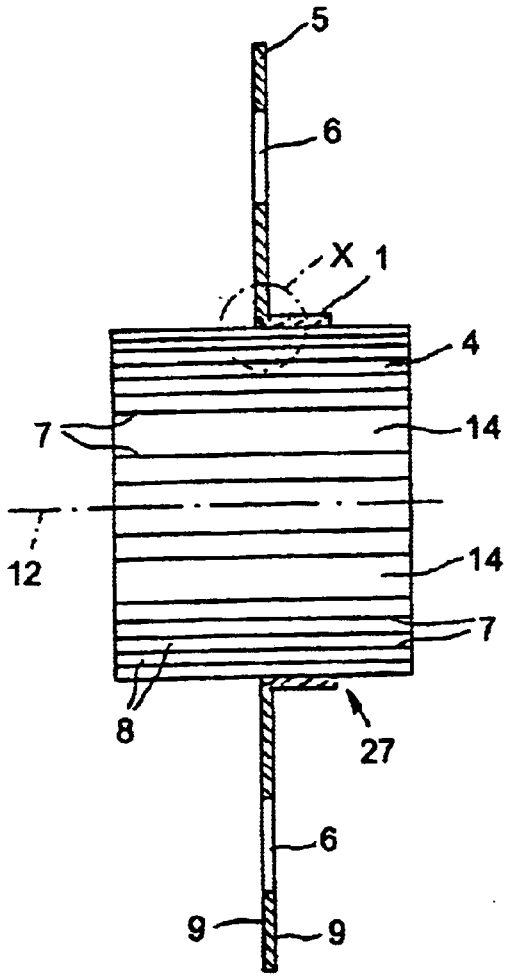
FIG. 10 is a full sectional view of a further exemplary embodiment of a catalyst carrier configuration according to the invention.

FIG. 10 is a full sectional view of a further exemplary embodiment of a catalyst carrier configuration. The catalyst carrier configuration has a catalyst carrier 4. The catalyst carrier body 4 has a plurality of passages 8 which are separated from one another by partition walls 7 and extend in the longitudinal direction of the longitudinal axis 12 of the catalyst carrier.

The housing 1 surrounds the catalyst carrier 4. The housing 1 has an extent in the longitudinal direction of the catalyst carrier 1 which is smaller, in particular significantly smaller, than the length of the catalyst carrier 4.

The housing 1 is of annular construction. The housing 1 is connected to a flange 5 which, together with the housing 1, forms a carrying unit 27. The flange 5 as such may form a seal.

Figure 11:
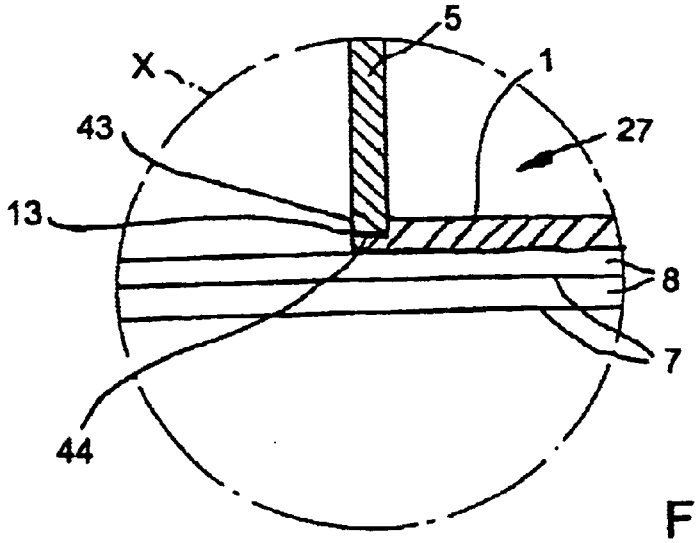
FIG. 11 is an enlarged sectional view of a detail X according to FIG. 10.

The flange 5 has a passage opening 13 through which the catalyst carrier 4 extends. A section 43 which is adjacent to the passage opening 13 projects into the housing 1. The housing 1 has a continuous, encircling recess 44, into which the section 43 projects. In the exemplary embodiment illustrated the recess 44 is in the form of a step, as can be seen from FIG. 11. The recess 44 is delimited by two faces or surfaces which run essentially perpendicular to one another and against which the flange 5 bears. The transition region between the flange 5 and the housing 1 is sharp-edged, so that the catalyst carrier configuration is able to adopt a predefined installation position. The flange 5 is preferably joined to the housing 1 through the use of a soldered joint. As an alternative, the flange 5 may be joined to the housing 1 by welding. The soldered joint between the flange 5 and the housing 1 may be formed at the same time as a soldered joint between the housing 1 and the catalyst carrier. In order to ensure that the flange 5 does not leave its predetermined position when handling the unsoldered catalyst configuration, it is suggested to connect the flange 5 to the housing 1 in a force-fitting and/or form-fitting manner.

In addition to the housing 1 illustrated in FIG. 10, at least one housing part may be provided at a distance from the housing 1. Such an configuration is expedient in particular if the catalyst carrier 4 is a metallic catalyst carrier which is wound in the form of an S.

Figures 12, 13, 14:
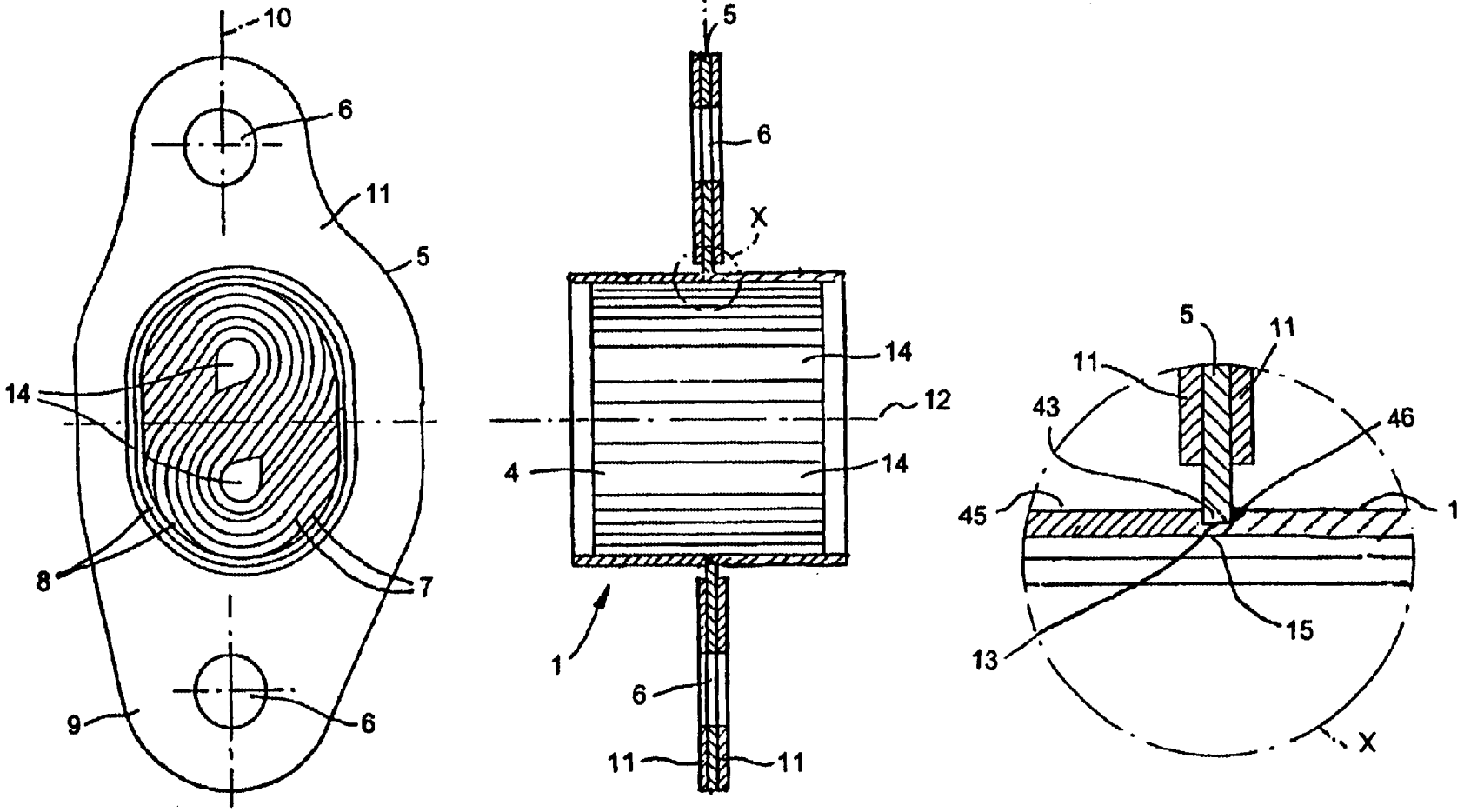
FIG. 12 is a front view of a further exemplary embodiment of a catalyst carrier configuration according to the invention.
FIG. 13 is a sectional side view of the catalyst carrier configuration according to FIG. 12.
FIG. 14 is an enlarged sectional view of a detail X according to FIG. 13.

FIGS. 12, 13 and 14 show a further embodiment of a catalyst carrier configuration. The catalyst carrier configuration has a single-part housing 1. A catalyst carrier or catalyst carrier body 4 is disposed in the housing 1. The catalyst carrier 4 has a plurality of passages 8 which are separated from one another by partitions 7. The passages 8 extend in the longitudinal direction of the catalyst carrier. The partitions 7 may be formed by metal sheets which are at least partially structured.

The catalyst carrier configuration has a flange 5. A section 43 of the flange 5 projects partially into the housing 1. The housing 1 has a recess 46 in its outer wall 45. The section 43 of the flange 5 projects into the recess 46. The recess 46 is formed by a groove. The groove 46 is configured so as to run in a continuous manner, in other words uninterrupted, around the circumferential direction of the housing 1.

The joint, which is illustrated in particular in FIG. 14, between the flange 5 and the housing 1 may also be formed by dividing the housing 1 in the region of the recess 46.

The section 43 of the flange 5 is preferably introduced into the recess 46 in the housing 1 by providing the external diameter of the housing 1, in the uninstalled state of the housing 1, with a smaller diameter than the internal diameter of the passage opening 13, preferably a little smaller than the internal diameter of the passage opening 13 of the flange 5. The flange 5 is positioned in the region of the recess 46. Then, the housing 1 is widened at least in the region of the recess 46, so that the section 43 of the flange 5 passes into the recess 46. The housing 1 may be widened, by way of example, by plastic deformation of the housing 1. This plastic deformation can be achieved by mechanically acting on the housing 1. The housing 1 can also be widened by applying a pressurized medium, in particular air, to the internal chamber of the housing 1.

In the exemplary embodiment illustrated, the flange 5 has sealing elements 11 which are disposed on both sides of the flange 5. The sealing elements 11 end at a distance from the first housing part and the second housing part 3, as is illustrated in particular in FIG. 14.

The axial extent of the housing 1 essentially corresponds to the axial extent of the catalyst carrier 4. This is however not obligatory. The axial extent of the individual housing parts or both housing parts 2, 3 may also be less than the axial extent of the catalyst carrier 4. The catalyst carrier 4 may also project out of the housing 1.

Figure 17:
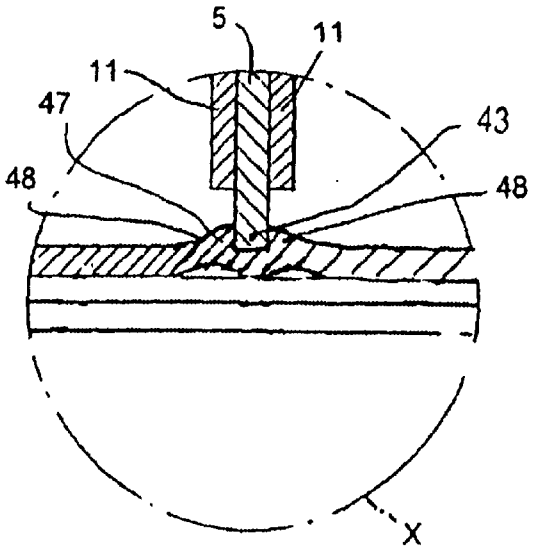
FIG. 17 is an enlarged sectional view of a detail X according to FIG. 16.
Figure 16:
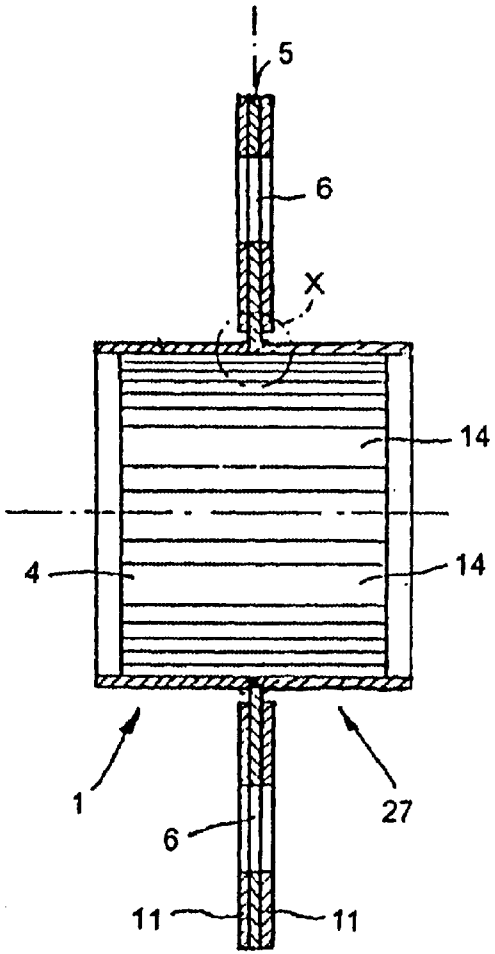
FIG. 16 is a sectional side view of the catalyst carrier configuration according to FIG. 15.
Figure 15:
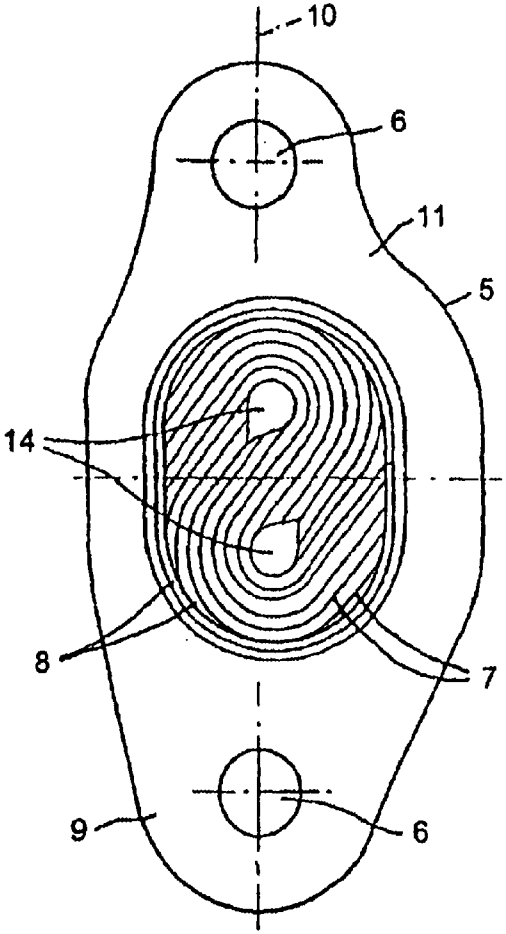
FIG. 15 is a front view of a further exemplary embodiment of a catalyst carrier configuration according to the invention.

FIGS. 15 to 17 show a further exemplary embodiment of a catalyst carrier configuration. The catalyst carrier configuration includes a housing 1 and a flange 5. A catalyst carrier 4 is disposed in the housing 1. The catalyst carrier 4 has a plurality of passages which are separated from one another by partitions 7 and extend in the axial direction of the catalyst carrier 4. The partitions 7 extend essentially in the longitudinal direction of a longitudinal axis 12 of the catalyst carrier 4. FIG. 15 shows that the catalyst carrier 4 is formed essentially in the form of an S. It is formed by a plurality of layers of metal sheet which are at least partially structured.

The flange 5 extends essentially radially outward. It is of essentially platelike construction. In the exemplary embodiment illustrated, the flange 5 has two bores through which suitable attachment devices, in particular screws, can extend. Through the use these attachment devices the catalyst carrier configuration is connected to an exhaust system. The bores 6 lie on a common axis 10. However, this is not absolutely necessary. On its opposite faces, the flange 5 has sealing elements 11. The sealing elements have sealing surfaces 9. The seals 11 form a gastight connection between the exhaust system and the catalyst configuration and between a housing of an engine, in particular an internal combustion engine.

The flange 5 has a passage bore 13 through which the housing 1 extends. The flange 5 has a section 43 which is adjacent to the passage bore 13. The section 43 of the flange 5 extends partially into the housing 1. On its outer wall 45, the housing 1 has a recess 47. The section 43 projects into the recess 47. The recess 47 is formed by swaged or stamped sections 48 which are directed radially outward. In the exemplary embodiment illustrated, the swaged sections 48 are formed on both sides of the flange 5. The swaged sections are in the form of beads. They may also be configured in the form of nubs or in some other way. The swaged or stamped sections may be formed by rams, stamping machines or the like.

Figure 18:
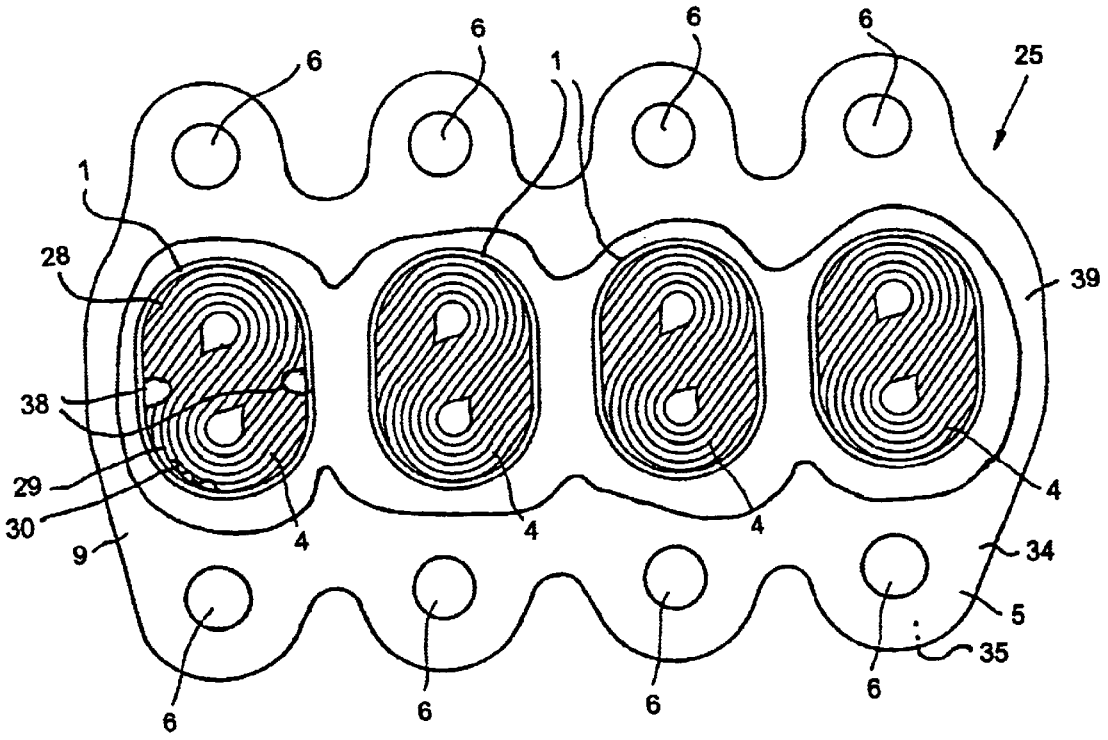
FIG. 18 is a plan front view of a first exemplary embodiment of a carrying unit with a catalyst carrier body according to the invention.

FIG. 18 shows a structural unit 25 having a plurality of housings 1 which have a common flange 5. The flange 5 is connected to the housings 1. The flange 5 is formed essentially transversely to the longitudinal extent of the housings 1.

In the exemplary embodiment illustrated in accordance with FIG. 18, each housing 1 is of oval construction. Other cross sections of the housings 1 are possible. It is not absolutely necessary for each housing 1 to have the same cross section. The cross sections of the housings 1 may be differently adapted to one another and the distance between the housings 1 may vary. The layout of the cross sections of the housings and their configuration relative to one another is determined essentially by the geometry of an internal combustion engine, in particular on the configuration of the outlet passages and the number of the outlet passages. In the exemplary embodiment illustrated, four housings 1 which are spaced apart from one another are provided.

The flange 5 is preferably configured in such a way that the opposite side faces 34, 35 in each case form a sealing surface. The side faces 34, 35 are used to connect the structural unit 25 in a sealed manner between a cylinder head and a manifold of an internal combustion engine.

It can be seen in particular from FIG. 18 that the side face 34 has a sealing surface 39 which is of a continuous, encircling construction. Each housing 1 is disposed inside that surface of the flange 5 which is delimited by the sealing surface 39. As an alternative, each housing 1 may be surrounded by at least one sealing surface. Instead of forming a sealing surface directly on the flange 5, it is also possible to use a sealing element which comes to bear against the collar 5.

In order to join the structural unit 25 to a cylinder head and/or a manifold of an internal combustion engine, the flange 5 has bores 6, through each of which a connecting element, for example, a screw or a threaded pin, can extend.

Preferably, each housing 1 has a stop 38 which projects into a chamber 28 in the housing 1. The stop 38 is preferably of annular configuration. The stop 38 may also be configured in the form of projections. The stop 38 is used to fix a catalyst carrier which is disposed in the chamber 28 in the housing 1.

In order to fix the flange 5 to a cylinder head or a manifold, the flange 5 has bores 6 through which, by way of example, a screw can extend.

A catalyst carrier 4 is disposed in each housing 1. The longitudinal extent of the catalyst carrier 4 preferably corresponds to the axial length of the housing 1. In the exemplary embodiment illustrated, the catalyst carrier 4 is a metallic honeycomb body which includes smooth metal sheets 29 and structured metal sheets 30, which between them delimit passages 8 for an exhaust gas. The catalyst carriers 4 extend on both sides of the flange 5.

As an alternative to a metallic catalyst carrier, it is also possible to use a ceramic catalyst carrier. In the case of such a use of a ceramic catalyst carrier, an insulating mat is provided between the catalyst carrier and the housing, with the result that different thermal expansions of the honeycomb body in the structural unit are compensated.

Figure 19:
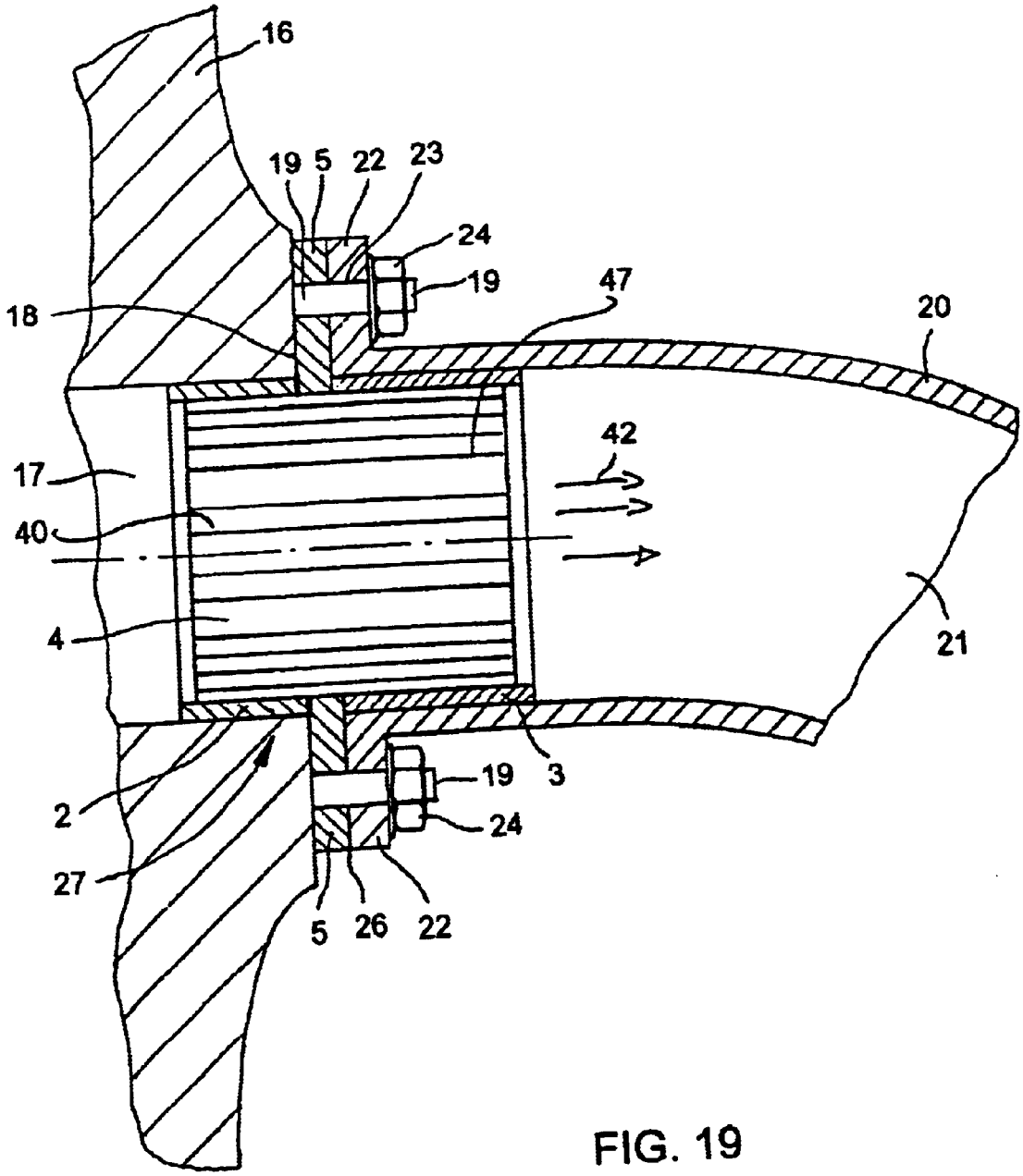
FIG. 19 is a partial sectional view an exhaust system according to the invention.

The catalyst carrier configuration according to the invention is particularly suitable for installation close to the engine. FIG. 19 shows the catalyst carrier configuration illustrated in FIG. 2 in the installed position. A cylinder head 16 of an internal combustion engine has an outlet passage 17. The opening of the outlet passage 17 is surrounded by a sealing surface 18.

A catalyst carrier 4 partially projects into the outlet passage 17. The catalyst carrier 4 is provided in a two-part housing 1. That section 40 of the catalyst carrier 4 which is provided in the carrying unit 27 formed by the flange S and the first housing part 2 projects into the outlet passage 17. The flange 5 bears against a sealing surface 18 of the cylinder head 16. The flange 5 is configured as a metallic seal. Threaded bolts 19 extend through the openings 6 in the flange 5.

The second housing part 3, together with that section 41 of the catalyst carrier 4 which is provided in the second housing part 3, projects into an exhaust duct 21 of the manifold 20. The exhaust duct 21 forms an exhaust-gas flow path 42 for an exhaust gas from the internal combustion engine.

The manifold 20 has a connection piece 22. The connection piece 22 has bores 23 which are of corresponding construction to the bores 6 of the flange 5. Threaded bolts 19, which are connected to the cylinder head 16, extend through the bores 6 of the flange 5 and the bores 23 of the connection piece 22. In order to fix the manifold 20 and the flange 5 on the cylinder head 16, nuts 24 are screwed onto the threaded bolts 19.

As has already been explained above, the flange 5 is configured in the form of a metallic seal. This configuration of the flange 5 produces a gastight connection between the cylinder head 16 and the manifold 20. For this purpose, the flange 5 bears against the sealing surface 18 of the cylinder head 16. The connection piece 22 also has a sealing surface 26, which comes to bear against the flange 5. The manifold 20, together with the catalyst carrier configuration, forms part of an exhaust system of an internal combustion engine.

If an internal combustion engine has a plurality of outlet passages 17, a catalyst carrier configuration may be positioned in each outlet passage.

We claim:

1. A catalyst carrier configuration, comprising:

a housing having a wall with an outer wall surface;

at least one catalyst carrier body disposed in said housing, said at least one catalyst carrier body defining an axial direction and having partition walls defining a plurality of passages separated from one another by said partition walls and extending substantially in the axial direction; and at least one flange surrounding at least said at least one catalyst carrier body and extending substantially radially outwards from said wall, said at least one flange having at least one section extending at least partially through said outer wall surface and into said wall and being configured to be disposed between a cylinder head and a manifold of an internal combustion engine.

2. The catalyst carrier configuration according to claim 1, wherein said housing has a seat at said outer wall surface, said at least one section of said at least one flange projects into said seat.

3. The catalyst carrier configuration according to claim 2, wherein said seat is a groove.

4. The catalyst carrier configuration according to claim 3, wherein said groove is a continuous groove encircling said housing.

5. The catalyst carrier configuration according to claim 2, wherein said outer wall surface has at least one stamped section extending radially outwards from said outer wall surface, said seat is formed by said at least one stamped section.

6. The catalyst carrier configuration according to claim 1, wherein said at least one flange has two sides, said outer wall surface has at least one stamped section disposed on each of said two sides of said at least one flange.

7. The catalyst carrier configuration according to claim 5, wherein said at least one stamped section is formed as a bead.

8. The catalyst carrier configuration according to claim 6, wherein said at least one stamped section is formed as a bead.

9. The catalyst carrier configuration according to claim 1, wherein said at least one section of said at least one flange extends as far as said at least one catalyst carrier body.

10. The catalyst carrier configuration according to claim 1, wherein said housing has at least two housing parts, said at least one catalyst carrier body has a longitudinal extent, each of said at least two housing parts extends over a respective part of the longitudinal extent of said at least one catalyst carrier body.

11. The catalyst carrier configuration according to claim 1, wherein said at least one catalyst carrier body has a length along the axial direction, said housing has a longitudinal extent smaller than said length of said at least one catalyst carrier body.

12. The catalyst carrier configuration according to claim 1, wherein said at least one catalyst carrier body has a length along the axial direction, said housing has a longitudinal extent substantially smaller than said length of said at least one catalyst carrier body.

13. The catalyst carrier configuration according to claim 1, wherein said housing is an annular-shaped housing.

14. The catalyst carrier configuration according to claim 10, wherein said at least two housing parts are annular-shaped housing parts.

15. The catalyst carrier configuration according to claim 1, wherein said housing has at least one stop, said at least one catalyst carrier body bears against said at least one stop.

16. The catalyst carrier configuration according to claim 10, wherein at least one of said at least two housing parts has at least one stop, said at least one catalyst carrier body bears against said at least one stop.

17. The catalyst carrier configuration according to claim 1, wherein said at least one flange has at least one sealing surface.

18. The catalyst carrier configuration according to claim 17, wherein said at least one sealing surface forms an essentially continuous loop.

19. The catalyst carrier configuration according to claim 17, including at least one sealing element disposed at said at least one flange.

20. The catalyst carrier configuration according to claim 1, wherein said at least one flange forms a seal.

21. The catalyst carrier configuration according to claim 1, wherein said at least one flange has at least one plate-shaped section.

22. The catalyst carrier configuration according to claim 1, wherein said at least one flange is brazed at least to said housing.

23. The catalyst carrier configuration according to claim 1, wherein said at least one catalyst carrier body is a metallic catalyst carrier body.

24. The catalyst carrier configuration according to claim 1, wherein said at least one flange is brazed at least to said at least one catalyst carrier body.

25. The catalyst carrier configuration according to claim 1, wherein said at least one catalyst carrier body is a ceramic catalyst carrier body.

26. The catalyst carrier body according to claim 1, wherein said passages have respective cross-sections, said at least one catalyst carrier body has a region formed with at least one main passage having a given cross-section larger than said respective cross-sections of said passages.

27. A structural unit, comprising:

at least two catalyst carrier configurations, each including a housing having a wall with an outer wall surface and a catalyst carrier body disposed in said housing, said catalyst carrier body defining an axial direction and having partition walls defining a plurality of passages separated from one another by said partition walls and extending substantially in the axial direction; and a common flange surrounding said catalyst carrier body of each of said at least two catalyst carrier configurations and extending substantially radially outwards, said common flange having at least one section extending at least partially through said outer wall surface and into said wall of each of said at least two catalyst carrier configurations and being configured to be disposed between a cylinder head and a manifold of an internal combustion engine.

28. The structural unit according to claim 27, wherein said common flange forms a common sealing surface, said catalyst carrier body of each of said at least two catalyst carrier configurations is disposed inside said common sealing surface.

29. An exhaust system for an internal combustion engine, comprising:

an exhaust system component defining at least one exhaust flow path; and a catalyst carrier configuration including a housing having a wall with an outer wall surface, at least one catalyst carrier body disposed in said housing and provided at least partly in said at least one exhaust flow path, said at least one catalyst carrier body defining an axial direction and having partition walls defining a plurality of passages separated from one another by said partition walls and extending substantially in the axial direction, and at least one flange surrounding at least said at least one catalyst carrier body and extending substantially radially outwards from said wall, said at least one flange having at least one section extending at least partially through said outer wall surface and into said wall and being configured to be disposed between a cylinder head and a manifold of an internal combustion engine.

30. An exhaust system for an internal combustion engine, comprising:

an exhaust system component defining exhaust flow paths; and a structural unit including at least two catalyst carrier configurations, each including a housing having a wall with an outer wall surface and a catalyst carrier body disposed in said housing and provided at least partly in a respective one of said exhaust flow paths, said catalyst carrier body defining an axial direction and having partition walls defining a plurality of passages separated from one another by said partition walls and extending substantially in the axial direction, and a common flange surrounding said catalyst carrier body of each of said at least two catalyst carrier configurations and extending substantially radially outwards, said common flange having at least one section extending at least partially through said outer wall surface and into said wall of each of said at least two catalyst carrier configurations and being configured to be disposed between a cylinder head and a manifold of an internal combustion engine.

31. The exhaust system according to claim 29, wherein said at least one exhaust flow path includes a plurality of exhaust flow paths, said at least one catalyst carrier body includes a plurality of catalyst carrier bodies each disposed in a respective one of said exhaust flow paths.

32. The exhaust system according to claim 30, wherein said catalyst carrier body of each of said least two catalyst carrier configurations is disposed in a respective one of said exhaust flow paths.

33. The exhaust system according to claim 29, wherein said housing together with said at least one catalyst carrier body has a given cross-section, said at least one exhaust flow path has a cross-section essentially corresponding to said given cross-section.

34. The exhaust system according to claim 30, wherein said housing together with said catalyst carrier body has a given cross-section, said exhaust flow paths respectively each have a cross-section essentially corresponding to said given cross-section.

35. The exhaust system according to claim 29, including at least one manifold having at least one connection piece to be connected to the internal combustion engine, said at least one flange bears at least partially against said at least one connection piece.

36. The exhaust system according to claim 30, including at least one manifold having at least one connection piece to be connected to the internal combustion engine, said common flange bears at least partially against said at least one connection piece.

37. The exhaust system according to claim 35, wherein said at least one flange is connected to said at least one connection piece in a gastight manner.

38. The exhaust system according to claim 36, wherein said common flange is connected to said at least one connection piece in a gastight manner.

39. In combination with an internal combustion engine having a cylinder head and a manifold, a catalyst carrier configuration, comprising:

a housing having a wall with an outer wall surface;

at least one catalyst carrier body disposed in said housing, said at least one catalyst carrier body defining an axial direction and having partition walls defining a plurality of passages separated from one another by said partition walls and extending substantially in the axial direction; and at least one flange surrounding at least said at least one catalyst carrier body and extending substantially radially outwards from said wall, said at least one flange having at least one section extending at least partially through said outer wall surface and into said wall and disposed between the cylinder head and the manifold of the internal combustion engine.

40. The catalyst carrier configuration according to claim 1, wherein said least one section penetrates at least partially into said wall.

* * * * *